US007422804B2

(12) United States Patent
Chun et al.

(10) Patent No.: US 7,422,804 B2
(45) Date of Patent: Sep. 9, 2008

(54) METAL DUSTING RESISTANT STABLE-CARBIDE FORMING ALLOY SURFACES

(75) Inventors: ChangMin Chun, Belle Mead, NJ (US); James D. Mumford, Long Valley, NJ (US); Trikur A. Ramanarayanan, Somerset, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 119 days.

(21) Appl. No.: 11/048,226

(22) Filed: Feb. 1, 2005

(65) Prior Publication Data

US 2005/0170197 A1 Aug. 4, 2005

Related U.S. Application Data

(60) Provisional application No. 60/541,359, filed on Feb. 3, 2004.

(51) Int. Cl.
*B32B 9/00* (2006.01)

(52) U.S. Cl. ..... 428/698

(58) Field of Classification Search ..... 428/698, 428/701, 408
See application file for complete search history.

(56) References Cited

U.S. PATENT DOCUMENTS

| | | | | |
|---|---|---|---|---|
| 3,366,475 | A | 1/1968 | Kaarlela | 76/134 |
| 4,341,834 | A * | 7/1982 | Kikuchi et al. | 428/216 |
| 5,575,902 | A | 11/1996 | Heyse et al. | 208/48 |
| 6,093,260 | A | 7/2000 | Petrone et al. | |
| 6,267,825 | B1 | 7/2001 | Stall et al. | 148/237 |
| 6,268,067 | B1 | 7/2001 | Petrone et al. | |
| 6,274,113 | B1 | 8/2001 | Heyse et al. | 423/418.2 |
| 6,503,347 | B1 | 1/2003 | Wysiekierski et al. | |
| 6,585,864 | B1 | 7/2003 | Fisher et al. | |
| 2002/0028323 | A1 * | 3/2002 | Nakamura et al. | 428/216 |
| 2002/0043479 | A1 | 4/2002 | Heyse et al. | |
| 2002/0192494 | A1 | 12/2002 | Tzatzov et al. | |
| 2003/0118859 | A1 | 6/2003 | Wysiekierski et al. | |

FOREIGN PATENT DOCUMENTS

| | | |
|---|---|---|
| EP | 0 906 967 A2 | 9/1998 |
| EP | 0 956 373 B1 | 8/2001 |
| EP | 2002105619 | 10/2002 |
| EP | 1288328 A1 | 3/2003 |
| GB | 2 066 696 A | 7/1981 |

(Continued)

OTHER PUBLICATIONS

C. Rosado et al., "Protective Behaviour of Newly Developed Coatings Against Metal Dusting", Materials and Corrosion 2003, vol. 54, No. 11, pp. 831-853, Wiley-VCH Verlag GmbH & Co. KGaA, Weinheim.

(Continued)

*Primary Examiner*—Keith D. Hendricks
*Assistant Examiner*—Daniel Miller
(74) *Attorney, Agent, or Firm*—Robert A. Migliorini

(57) ABSTRACT

A metal dusting resistant composition comprises an alloy capable of forming a thermally stable titanium carbide coating on its surface when exposed to a carbon supersaturated environment and, a protective coating on the alloy surface comprising an outer oxide layer and an inner carbide layer between the alloy surface and the outer layer.

7 Claims, 6 Drawing Sheets

FOREIGN PATENT DOCUMENTS

| | | | |
|---|---|---|---|
| JP | 07278782 | | 10/1995 |
| JP | 08246123 | | 9/1996 |
| JP | 2002105619 | A | 4/2002 |
| WO | WO 97/41275 | | 11/1997 |
| WO | WO 01/90441 | A1 | 11/2001 |
| WO | WO 01/94664 | A2 | 12/2001 |
| WO | WO 02053792 | A1 | 7/2002 |
| WO | WO 03/020637 | A1 | 3/2003 |

OTHER PUBLICATIONS

Weber, T., et al., "Development of Coatings for Environments with High Sulfur and/or Carbon Activities at Low Oxygen Potentials", NACE International, Corrosion 2002 (Conference Article).

* cited by examiner

METAL DUSTING RESISTANT STABLE-CARBIDE FORMING ALLOY SURFACES

This application claims the benefit of U.S. Ser. No. 60/541,359 filed Feb. 3, 2004.

FIELD OF INVENTION

The present invention is concerned with the phenomenon of metal dusting experienced in metal apparatus when exposed at high temperature to environments having high carbon activities and relatively low oxygen activities. More particularly, the present invention relates to the generation of metal dusting resistant alloys for the internal surfaces of high temperature apparatus.

BACKGROUND OF INVENTION

Hydrocarbon conversion processes in which a hydrocarbon or mixture of hydrocarbons and steam or a hydrocarbon and one or more of hydrogen, carbon monoxide and carbon dioxide are well known processes that are conducted at high temperatures and pressures in apparatus typically made of steels containing one or more of Ni and Co. Carburization of system metallurgy and metal dusting, are problems encountered with using such steels.

In general, metal dusting of steels is experienced at temperatures in the range of 300° C. to 900° C. in carbon supersaturated (carbon activity>1) environments having relatively low (about $10^{-10}$ to about $10^{-20}$ atmospheres) oxygen partial pressures. Basically rapid carbon transfer to the steel leads to "metal dusting", a release of particles of the bulk metal.

Methodologies available in the literature to control metal dusting corrosion involve the use of surface coatings and gaseous inhibitors, especially $H_2S$. Coatings can degrade by inter diffusion of the coating constituents into the alloy substrate. Thus they tend to be suitable for short term protection but generally are not advisable for long term protection, especially for twenty or more years.

Corrosion inhibitors using $H_2S$ has two main disadvantages. One is that $H_2S$ tends to poison most catalysts used in hydrocarbon conversion processes. Another is that $H_2S$ needs to be removed from the exit process stream which can be expensive.

An object of the present invention is to provide improvements in reducing metal dusting corrosion.

Another object is to provide materials that are resistant to metal dusting corrosion in petrochemical processes where carbon supersaturated and low oxygen partial pressure environments are present.

SUMMARY OF INVENTION

In one aspect, the invention provides a metal dusting resistant composition comprising: (a) an alloy capable of forming a thermodynamically stable titanium carbide coating on its surfaces when exposed to a carbon supersaturated environment and, (b) a protective coating on said alloy surface comprising an outer oxide layer and an inner carbide layer between the alloy surface and the outer layer.

In another aspect, the invention includes a method for inhibiting the metal dusting of metal surfaces exposed to carbon supersaturated environments comprising constructing said metal of an alloy or coating a metal surface with an alloy capable of forming a first, thermodynamically stable carbide layer and a second, oxide layer on said first layer and exposing the alloy to a carbon supersaturated, low oxygen partial pressure atmosphere at a temperature and for a time sufficient to form a metal dusting inhibiting coating on the metal surface.

DETAILED DESCRIPTION OF THE INVENTION

Figure 1:
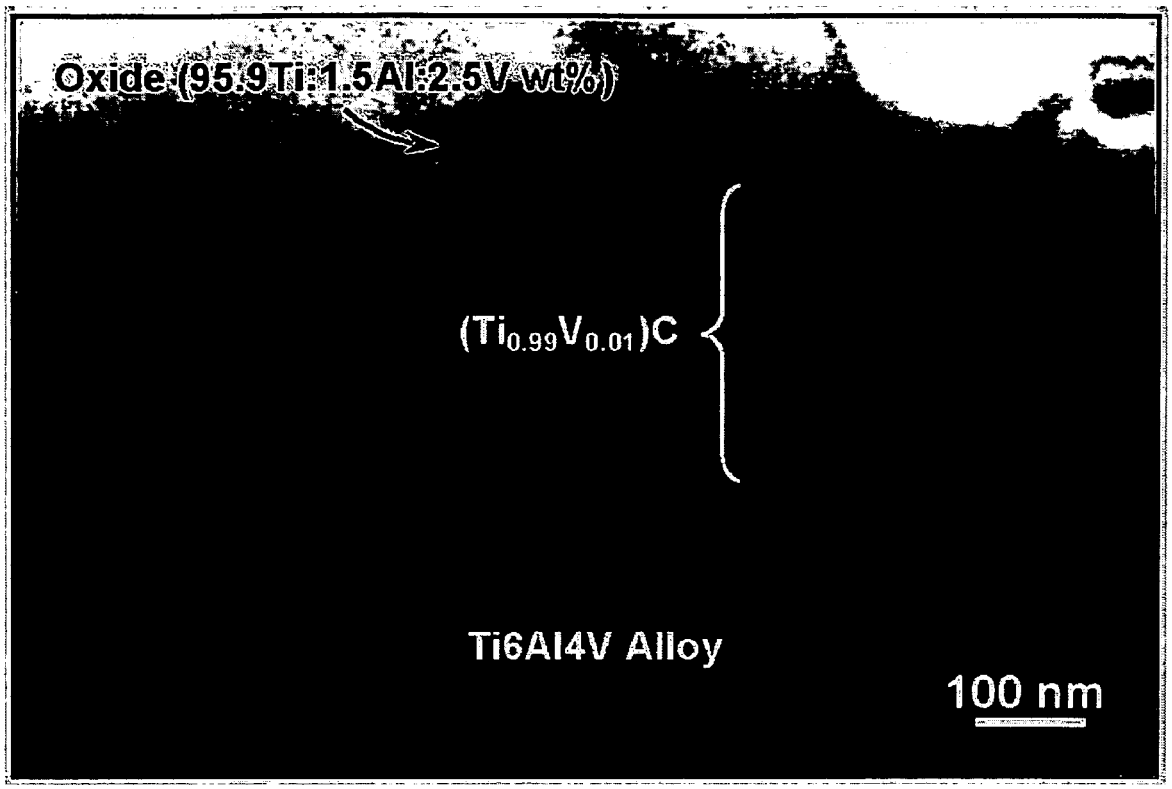
FIG. 1 is a cross sectional transmission electron microscopic (TEM) image of a Ti6Al4V alloy after 66 hrs at 650° C. in a carbon supersaturated atmosphere.

As mentioned above, in many high temperatures (300° C. to 900° C.) hydrocarbon processing applications, stainless steel is employed as a structural component in reactors, heat exchanges piping and the like. When the surface of these structural members is exposed to a carbon supersaturated environment it undergoes a carbon-induced corrosion known as metal dusting. One object of the present invention is to inhibit such metal dusting.

Accordingly, in one aspect of the invention there is provided a composition comprising: (a) a metal alloy capable of forming a thermodynamically stable carbide coating on the surface of the alloy; and (b) a protective coating on the alloy surface comprising an outer oxide layer and an inner carbide layer between the alloy surface and the outer layer.

Thus, in one embodiment of the invention a structural member is formed from the alloy, (a), and is protected by the coating (b). In a second, embodiment structural number is formed from an iron alloy substrate, such as stainless steel, which is provided, on a surface to be exposed to a carbon supersaturated environment, with an alloy (a) and a protective coating (b).

A suitable class of alloys, (a), of the invention are those comprising at least 50 wt % of a metal selected from the group consisting of Fe, Ni, Co, and mixtures thereof; at least 10 wt % Ti, at least 15 wt % Cr; and, about 0.1 wt % to about 25 wt % of alloying components. Among suitable alloying components include Mn, Al, Si, Y, Zr, Hf, V, Nb, Ta, Mo, W, Re, Cu, Sn, Ga, C, O, N and mixtures thereof. Examples of such alloys are given in Table 1.

TABLE 1

| Alloy Name | Wt % of Components |
|---|---|
| EM-FeCrNiTi | Bal Fe-25.1 Cr-10.2 Ni-10.0 Ti-0.1 Zr |
| EM-NiCrTiAl | Bal Ni-20.0 Cr-10.0 Ti-1.5 Al |
| EM-NiCrCoTiAl | Bal Ni-15.0 Cr-15.0 Co-10.0 Ti-5.5 Al |
| EM-NiCrCoTiMoWAl | Bal Ni-18.0 Cr:-15.0 Co-10.0 Ti-3.0 Mo-1.5 W-2.5 Al |

Alloys of this class may be used as structural components or as coatings on steel substrates.

Another suitable class of alloys, (a), are those comprising at least 70 wt % Ti and from about 0.1 wt % to about 30 wt % of alloying components such as those listed above. Indeed a particularly preferred alloy of this class comprises at least 70 wt % Ti, 0.1 wt % to 30 wt % Al and from 0.0 wt % to 5 wt % V. Alloys of the second class preferably are used as coatings on steel substrates rather than as structural members themselves.

TABLE 2

| Alloy Name | Wt % of Components |
|---|---|
| Ti64 | Bal Ti-6 Al-4 V |
| IMI-550 | Bal Ti-4 Al-2 Sn-4 Mo-0.5 Si |
| Ti-811 | Bal Ti-8 Al-1 Mo-1 V |
| IMI-679 | Bal Ti-2 Al1-11 Sn-5 Zr-1 Mo-0.2 Si |
| Ti-6246 | Bal Ti-6 Al-2 Sn-4 Zr-6 Mo |
| Ti-6242 | Bal Ti-6 Al-2 Sn-4 Zr-2 Mo |
| Hylite 65 | Bal Ti-3 Al-6 Sn-4 Zr-0.5 Mo-0.5 Si |
| IMI-685 | Bal Ti-6 Al-5 Zr-0.5 Mo-0.25 Si |
| Ti-5522S | Bal Ti-5 Al-5 Sn-2 Zr-2 Mo-0.2 Si |
| Ti-11 | Bal Ti-6 Al-2 Sn-1.5 Zr-1 Mo-0.1 Si-0.3 Bi |
| Ti-6242S | Bal Ti-6 Al-2 Sn-4 Zr-2 Mo-0.1 Si |
| Ti-5524S | Bal Ti-5 Al-5 Sn-2 Zr-4 Mo-0.1 Si |
| IMI-829 | Bal Ti-5.5 Al-3.5 Sn-3 Zr-0.3 Mo-1 Nb-0.3 Si |
| IMI-834 | Bal Ti-5.5 Al-4 Sn-4 Zr-0.3 Mo-1 Nb-0.3 Si-0.06 C |
| Ti-1100 | vTi-6 Al-2.75 Sn-4 Zr-0.4 Mo-0.45 Si |
| Beta-21S | Bal Ti-15 Mo-3 Al-2.75 Nb-0.25 Si |

In instances where a steel substrate is utilized in forming a structural component the alloys of the invention may be applied to the surface of the substrate to be exposed to a carburizing atmosphere by techniques such as thermal spraying, plasma deposition, chemical vapor deposition, sputtering and the like. In this embodiment the alloy deposition generally should have a thickness of from about 10 to about 200 microns, and preferably from about 50 to about 100 microns.

The protective coating on the bulk alloy or the alloy coated substrate, as the case may be, is prepared by exposing the alloy to a carbon supersaturated atmosphere having a low oxygen partial pressure at temperatures in the range of about 300° C. to about 1100° C. and for times sufficient to form a coating on the alloy comprising an outer oxide layer and a first carbide layer between the outer layer and the alloy surface. Typical times range from about 1 to 200 hours and preferably from about 1 to 100 hours.

A suitable carbon supersaturated atmosphere for forming the protective coating includes those atmospheres generated in hydrocarbon conversion processes such as CO, $CO_2$ and $H_2$ atmospheres generated by steam reforming of methane, or by partial oxidation of methane. Optionally, mixtures of appropriate atmospheres can be prepared such as a 50CO:50$H_2$ mixture. Hence, the protective coatings can be formed during or prior to use of the alloys under reaction conditions in which they are exposed to metal dusting environments.

The invention will be illustrated further by the following examples and comparative examples in which the corrosion kinetics of various alloy specimens were investigated by exposing the specimens to a 50CO-50$H_2$ vol % environment for 160 hrs at test temperatures of 550° C. and 650° C. respectively. A Cahn 1000 electrobalance was used to measure the carbon pick up of the specimen. Carbon pick up is indication of metal dusting corrosion. A cross section of the surface of the specimen also was examined using a transmission or scanning electron microscope.

EXAMPLE 1 AND COMPARATIVE EXAMPLES 1 TO 3

Following the procedure described above, samples of the following alloys were tested: Inconel 600 (7Fe:77Ni:16Cr (wt %)); KHR-45A (20Fe:45Ni:35Cr (wt %)); and, Ti6Al4V (90Ti:6Al4:V (wt %)). The results of the gravimetric measurements are shown in Table 3.

TABLE 3

| No | Alloy | Mass gain ($mg/cm^2$) at 550° C. | Mass gain ($mg/cm^2$) at 650° C. |
|---|---|---|---|
| Comp. 1 | Inconel 600 | 120 to 130 | 60 to 65 |
| Comp. 2 | KHR-45A | 230 to 250 | 140 to 160 |
| Ex. 1 | Ti6Al4V | 0.0 | 0.0 |
| Comp. 3 | 1¼ Cr ½ Mo Steel | >2000[1] | >1000[1] |

[1]Accurate weight gain measurement was not obtained because substantial amounts of carbon fell off the sample during the test.

FIG. 1 is a cross-sectional TEM image of the Ti6Al4V alloy after 66 hrs at 650° C. in the 50CO-50$H_2$ atmosphere.

Figure 2:
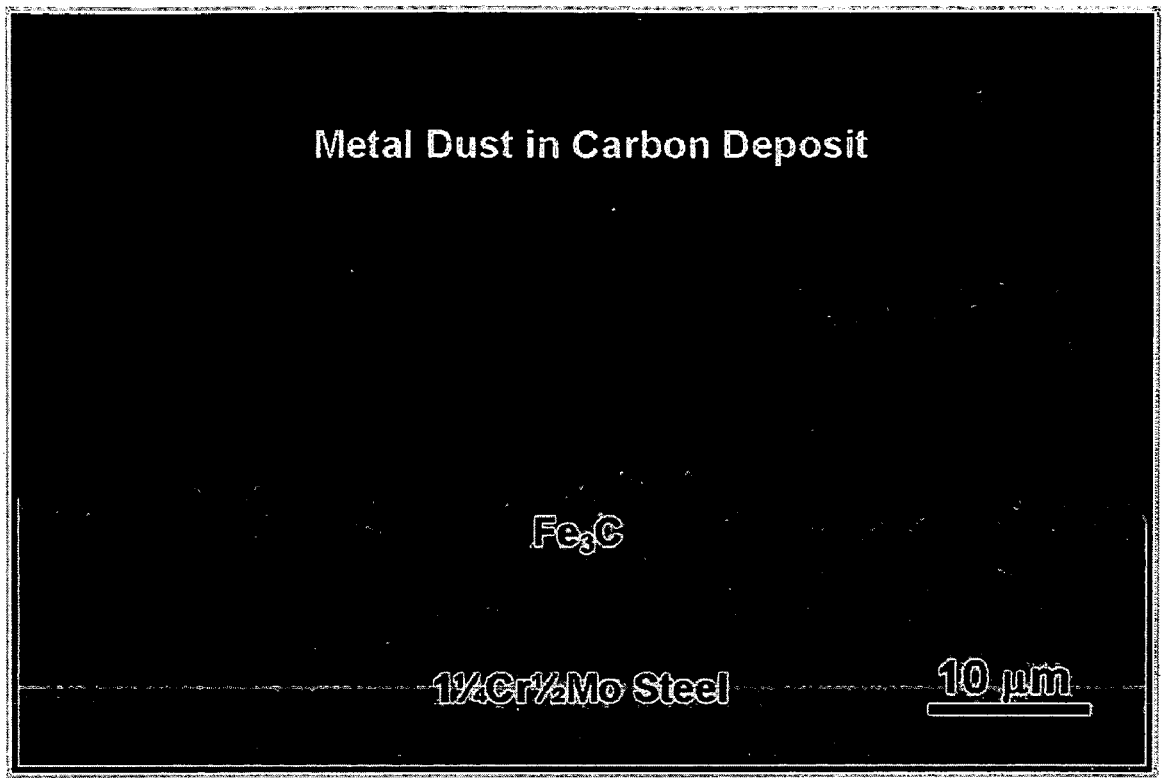
FIG. 2 is a cross sectional scanning electron microscopic (SEM) image of a 1¼Cu ½Mo steel after 4 hrs at 650° C. in a carbon supersaturated atmosphere.

FIG. 2 is a cross-sectional SEM image of the 1¼Cr ½Mo steel after 4 hrs at 650° C. in the 50CO-50$H_2$ atmosphere. Metastable $Fe_3C$ and carbon deposit is clearly present.

EXAMPLE 2 AND COMPARATIVE EXAMPLE 4

Two titanium containing alloys were prepared by arc melting. The Example 2 alloy contained 55Fe:25Cr:10Ni:10Ti (wt %). The Comparative Example 4 alloy contained 60Fe:25Cr:10Ni:5Ti (wt %). The arc-melted alloys were rolled into thin sheets of ~1/16 inch thickness. The sheets were annealed at 1100° C. overnight in inert argon atmosphere and furnace-cooled to room temperature. Rectangular samples of 0.5 inch×0.25 inch were cut from the sheets. The sample faces were polished to 600-grit finish and cleaned in acetone. They were exposed to a 10$CH_4$-90$H_2$ vol % gaseous environment at 1100° C. for 24 hours.

Figure 3:
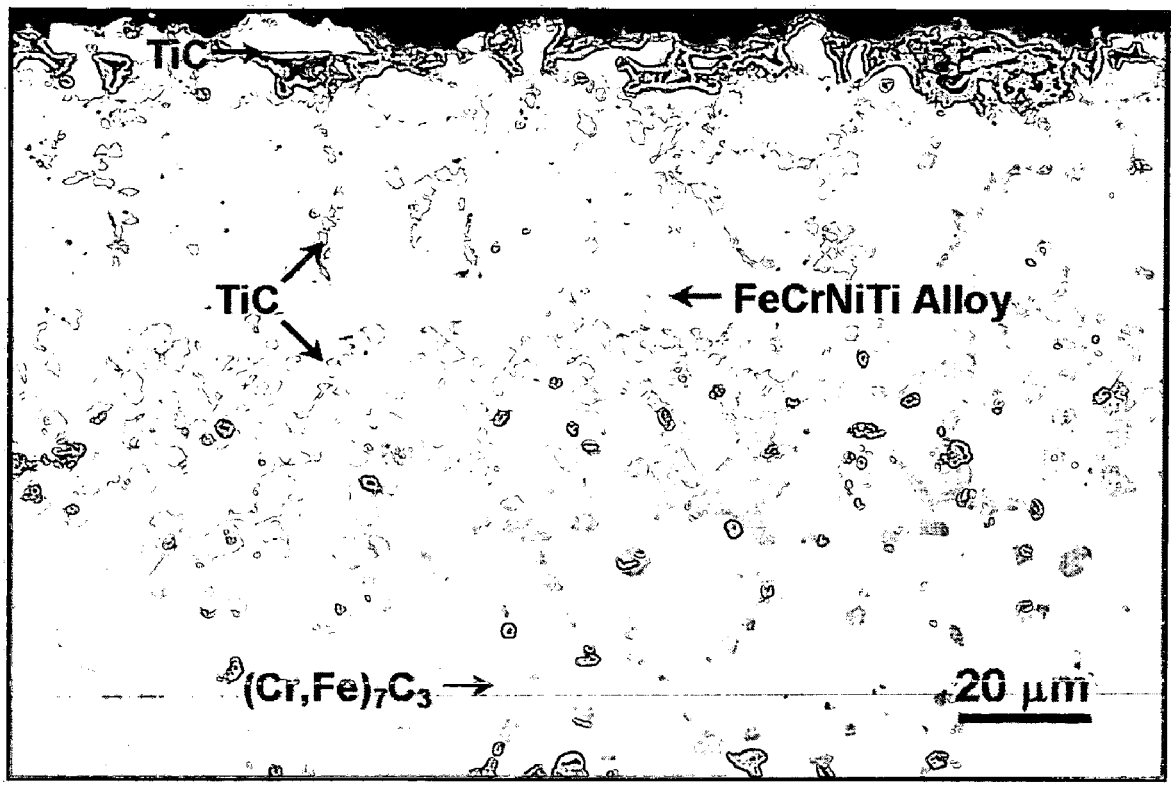
FIG. 3 is a cross sectional SEM image of a metal dusting resistant alloy of the invention after 24 hrs at 1100° C. in a carbon supersaturated atmosphere.

Shown in FIG. 3 is a cross sectional SEM image of the Example 2 alloy surface after exposure. In addition to a stable TiC surface layer, both TiC and $(Cr, Fe)_7C_3$ carbides were precipitated inside the alloy. The stable TiC surface layer was identified as the reason for the metal dusting resistance.

A cross sectional SEM image of the Comparative 2 alloy surface after exposure showed a discontinuous TiC surface layer which would not be very effective in providing metal dusting resistance.

COMPARATIVE EXAMPLES 5 AND 6

Titanium containing commercial alloys (Incoloy 800H and Incoloy 803) were also tested for metal dusting by exposing the specimens to a 50CO-50$H_2$ vol % gaseous environment at 550° C. for up to 160 hrs. After metal dusting exposure, the sample surface was covered with carbon, which always accompanies metal dusting corrosion. Susceptibility of metal dusting corrosion was investigated by optical microscopy and cross-sectional SEM examination of the corrosion surface. The average diameter and numbers of corrosion pits observed on the surface are used as a measure of metal dusting corrosion. These results are summarized in Table 4.

TABLE 4

| No. | Alloys | Composition | Diameter of Pits (μm) | Number of Pits per 25 $mm^2$ |
|---|---|---|---|---|
| Comp. 4 | Incoloy 800H | Bal Fe:34 Ni:20 Cr:0.5 Al:0.4 Si:0.8 Mn | 400 | 135 |
| Comp. 5 | Incoloy 803 | Bal Fe:35 Ni:25 Cr:0.5 Ti:1.5 Al:1.2 Si | 100 | 10 |

Figure 4:
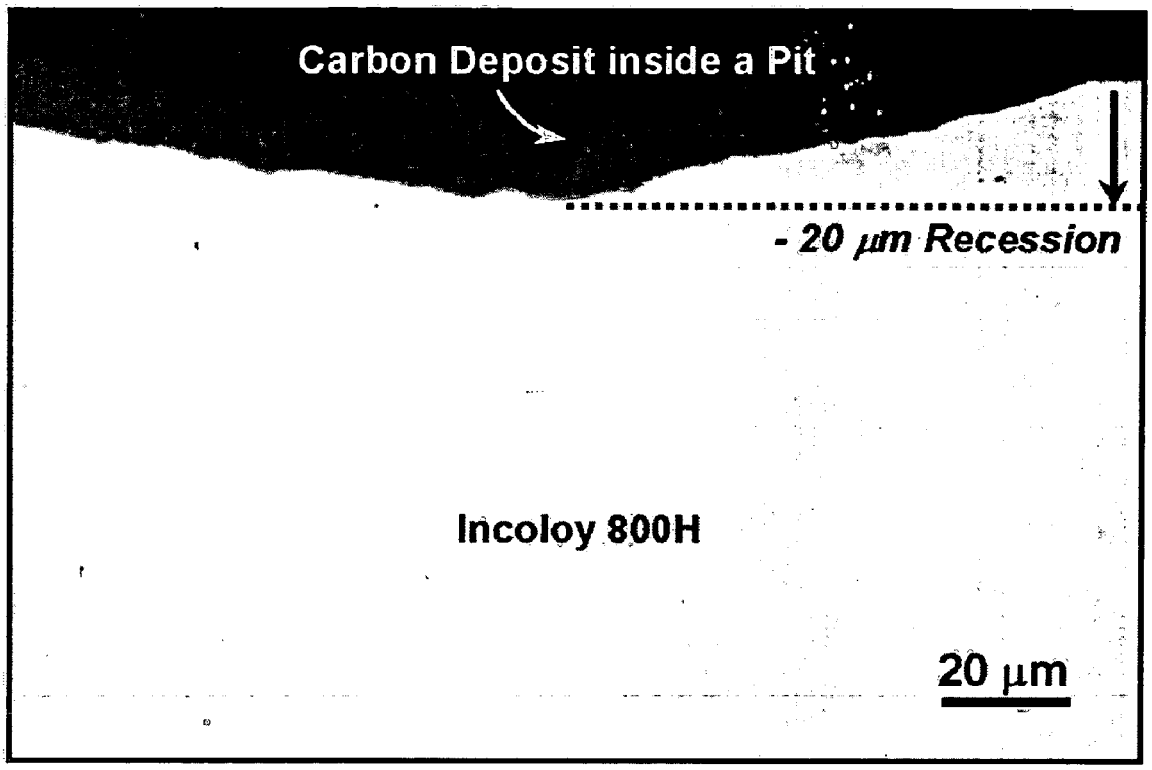
FIG. 4 is a cross sectional SEM image of an Incoloy 800H alloy after 160 hrs at 550° C. in a carbon supersaturated atmosphere.
Figure 5:
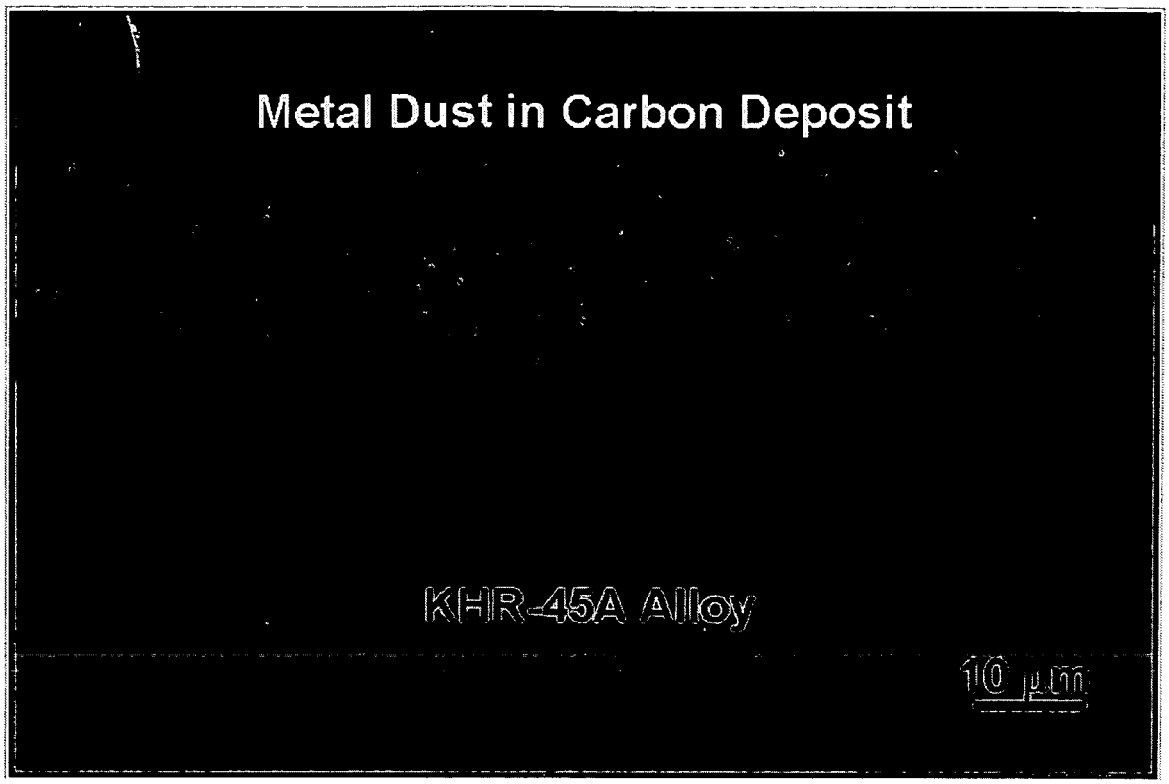
FIG. 5 is a cross sectional SEM image of a KHR-45A alloy after 160 hrs at 650° C. in a carbon supersaturated atmosphere.
Figure 6:
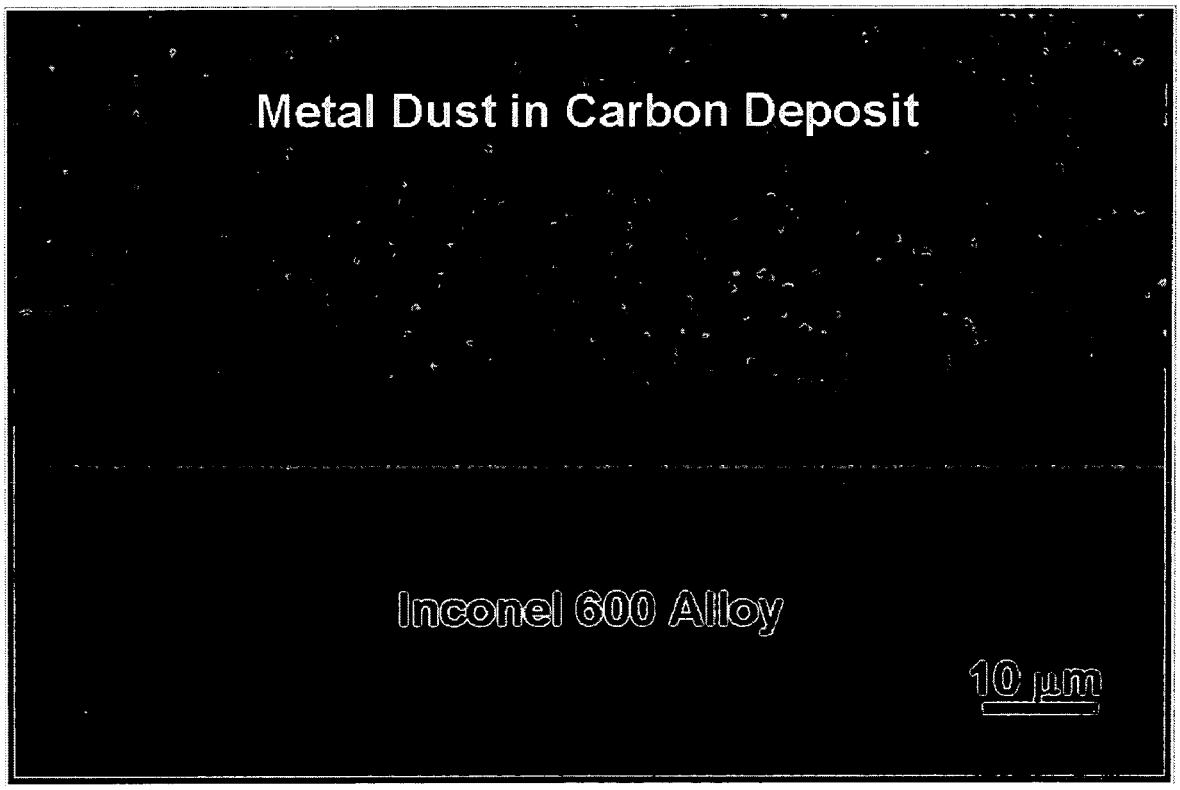
FIG. 6 is a cross sectional SEM image of an Inconel 600 alloy after 90 hrs at 550° C. in a carbon supersaturated atmosphere.

The Incoloy 800H alloy suffered extensive metal dusting attack as shown in Table 4. The electron microscopic image shown in FIG. 4 indicates a pitting morphology, characteristic of metal dusting, in the corroded region. Carbon deposition, which invariably accompanies such attack, is also seen in FIG. 4. The depth of this particular pit defined as a metal recession from the alloy surface is measured about 20 μm.

What is claimed is:

1. A method for inhibiting the metal dusting of metal apparatus having surfaces exposed to carbon supersaturated environments comprising:

constructing said metal apparatus according to the following composition:

(a) a metal substrate, (b) a titanium alloy layer on said metal substrate capable of forming a thermally stable carbide coating on the titanium alloy surface when exposed to a carbon supersaturated environment, wherein said titanium alloy layer comprises at least 50 wt % of a metal chosen from Fe, Ni, Co, and mixtures thereof, at least 10 wt % Ti, at least 15 wt % Cr; and about 0.1 wt % to about 25 wt % of alloying components chosen from Mn, Al, Si, Y, Zr, Hf, V, Nb, Ta, Mo, W, Re, Cu, Sn, Ga, C, O, N and mixtures thereof; and exposing the titanium alloy layer to a carbon supersaturated, low oxygen partial pressure atmosphere at a temperature and for a time sufficient to form a metal dusting inhibiting protective coating on the surface of the titanium alloy layer, wherein (c) said protective coating on the surface of said titanium alloy layer comprises an outer titanium oxide layer and an inner carbide layer between the surface of the titanium alloy layer and the outer oxide layer.

2. The method of claim 1 wherein the titanium alloy layer comprises at least 10 wt % Ti, at least 15 wt % Cr and about 0.1 wt % to about 25 wt % of alloying components.

3. A metal dusting resistant composition comprising:

(a) a metal substrate;

(b) a titanium alloy layer on said metal substrate capable of forming a thermally stable carbide coating on the titanium alloy surface when exposed to a carbon supersaturated environment, wherein the titanium alloy layer consists essentially of at least 50 wt % of a metal chosen from Fe, Ni, Co, and mixtures thereof, at least 10 wt % Ti, at least 15 wt % Cr; and about 0.1 wt % to about 25 wt % of alloying components chosen from Mn, Al, Si, Y, Zr, Hf, V, Nb, Ta, Mo, W, Re, Cu, Sn, Ga, C, O, N and mixtures thereof; and (c) a protective coating on the surface of said titanium alloy layer comprising an outer titanium oxide layer and an inner carbide layer between the surface of the titanium alloy layer and the outer oxide layer.

4. The composition of claim 3, wherein the titanium alloy layer is EM-FeCrNiTi.

5. The composition of claim 3, wherein the titanium alloy layer is EM-NiCrTiAl.

6. The composition of claim 3, wherein the titanium alloy layer is EM-NiCrCoTiAl.

7. The composition of claim 3, wherein the titanium alloy layer is EM-NiCrCoTiMoWAl.

* * * * *